US010126673B2

(12) United States Patent
Kobayashi et al.

(10) Patent No.: US 10,126,673 B2
(45) Date of Patent: Nov. 13, 2018

(54) SCANNING OPTICAL APPARATUS AND IMAGE FORMING APPARATUS

(71) Applicant: Konica Minolta, Inc., Chiyoda-ku, Tokyo (JP)

(72) Inventors: Daisuke Kobayashi, Hino (JP); Takashi Kurosawa, Hachioji (JP); Naoki Tajima, Hachioji (JP); Makoto Ooki, Toyohashi (JP); Hideo Uemura, Hachioji (JP)

(73) Assignee: KONICA MINOLTA, INC., Chiyoda-ku, Tokyo (JP)

( * ) Notice: Subject to any disclaimer, the term of this patent is extended or adjusted under 35 U.S.C. 154(b) by 0 days.

(21) Appl. No.: 15/816,987

(22) Filed: Nov. 17, 2017

(65) Prior Publication Data

US 2018/0157190 A1 Jun. 7, 2018

(30) Foreign Application Priority Data

Dec. 7, 2016 (JP) ..... 2016-237404

(51) Int. Cl.
*G03G 15/04* (2006.01)
*G03G 15/041* (2006.01)

(52) U.S. Cl.
CPC ... *G03G 15/04036* (2013.01); *G03G 15/0415* (2013.01)

(58) Field of Classification Search
CPC ..... G03G 15/04036; G03G 2215/04; G03G 2215/0402; G03G 15/0415; G02B 26/10; G02B 26/12; G02B 26/124
See application file for complete search history.

(56) References Cited

U.S. PATENT DOCUMENTS 8,472,097 B2 * 6/2013 Okamura ..... G02B 26/12 359/201.2
2004/0218029 A1 * 11/2004 Shiraishi ..... G02B 26/12 347/134
2006/0131491 A1 * 6/2006 Shimomura ..... G02B 26/125 250/234

FOREIGN PATENT DOCUMENTS

JP 2012-163977 8/2012

* cited by examiner

*Primary Examiner* — Sophia S Chen

(74) *Attorney, Agent, or Firm* — Squire Patton Boggs (US) LLP

(57) ABSTRACT

A scanning optical apparatus includes a light source, a deflector and an imaging optical system. The deflector deflects a beam emitted from the light source to scan a scanning surface with the beam in a main scanning direction. The imaging optical system focuses the beam on the scanning surface. The imaging optical system includes a first lens having negative power in a sub scanning direction and a second lens having positive power in the sub scanning direction, in which the sub scanning direction is parallel to the scanning surface and perpendicular to the main scanning direction. The power $\varphi 1$ of the first lens, the power $\varphi 2$ of the second lens and a magnification $\beta$ in the sub scanning direction of the imaging optical system satisfy the conditions $-1.2 \leq \varphi 1/\varphi 2 \leq -0.9$ and $-1.3 \leq \beta \leq -0.8$.

8 Claims, 5 Drawing Sheets

SCANNING OPTICAL APPARATUS AND IMAGE FORMING APPARATUS

BACKGROUND

1. Technological Field

The present invention relates to a scanning optical apparatus and an image forming apparatus.

2. Description of the Related Art

Printers and copiers for forming an image on a recording medium have been known in the art. Some image forming apparatuses including printers and copiers form an image on a recording medium by forming an electrostatic latent image by means of a scanning optical apparatus, forming a toner image from the formed electrostatic latent image and heating and pressing the toner image by means of a fixer to fix it on the recording medium.

Such scanning optical apparatuses are typically configured such that a deflector deflects a light beam from a laser source, and an imaging lens system focuses it into an optical spot on a scanning surface.

The laser source, which is often a semiconductor laser source or the like, emits divergent light. The divergent light is converted into an approximately parallel light beam by means of a collimator, and the outer shape of the light beam is restricted by means of an aperture. The deflector rotating at a constant angular velocity deflects the shaped light beam in a main scanning direction to direct it to the imaging lens system. The imaging lens system has an ID characteristic that allows the light beam deflected at the constant angular velocity to move at a constant scanning speed on the scanning surface. The imaging lens system is provided to form a minute light spot over the entire scanning area.

In the disclosure of JP 2012-163977A, the power ratio in a sub scanning direction between two fθ lenses are selected to reduce the field curvature and the spot size.

There is a need to reduce the size of such fθ lenses in order to achieve the reduced size, the higher precision and the reduced cost of print heads. While a reduction in size can be achieved by disposing an fθ lens near a deflector, resin lenses suffer from deviation (image plane shift) of the focal point in the sub scanning direction perpendicular to the main scanning direction in the direction of the optical axis according to a temperature change. Such an image plane shift causes an increase of the spot size on a scanning surface and thus deteriorates the sharpness of an image. Further, another problem is that an image plane shift in the sub scanning direction together with an optical face tangle of the deflector causes fluctuation of the spot on the scanning surface in the sub scanning direction and resultant uneven pitch (wobbling) in the sub scanning direction. This results in uneven bands in the image.

One solution to the problems is to dispose a resin lens in the optical system between a light source and the deflector so as to offset the image plane shift due to temperature change. This solution can thus prevent an increase of the spot size. However, this solution cannot correct the wobbling that is related to the conjugation of the fθ lens system.

In the disclosure of JP 2012-163977A, the power ratio in the sub scanning direction between two fθ lenses is selected to reduce the field curvature. While applying the technique to A4 sheets is disclosed as an embodiment, applying the technique to printing on larger sheets requires scaling of the optical system. Such scaling results in the larger field curvature and the larger spot size than disclosed values. Further, although such size reduction of the fθ lens by disposing it near a deflector can be achieved regardless of the printing size, it is often required to oppositely extend the distance (conjugation length) between the deflector and the scanning surface for reasons of the arrangement of the apparatus. A problem with the longer conjugation length is the larger spot size and larger wobbling due to the larger image plane shift.

Since the temperature fluctuates within the range of ±15° C. in an ordinary use environment, it is possible to prevent an increase of the spot size and the wobbling and to obtain high-quality images when the image plane shift due to a temperature change of lenses within this range is equal to or less than 2.6 mm.

SUMMARY

The present invention has been made in view of the above circumstances, and an object thereof is to reduce the image plane shift due to a temperature change and to prevent a resultant increase of the spot size and the wobbling while achieving a reduction in size by disposing lenses near a deflector.

To achieve at least one of the abovementioned objects, according to an aspect of the present invention, a scanning optical apparatus includes:

a light source;

a deflector which deflects a beam emitted from the light source to scan a scanning surface with the beam in a main scanning direction; and an imaging optical system which focuses the beam deflected by the deflector on the scanning surface, wherein the imaging optical system includes a first lens having negative power in a sub scanning direction and a second lens having positive power in the sub scanning direction, in which the sub scanning direction is parallel to the scanning surface and perpendicular to the main scanning direction, and wherein the power $\varphi 1$ in the sub scanning direction of the first lens, the power $\varphi 2$ in the sub scanning direction of the second lens and a magnification $\beta$ in the sub scanning direction of the imaging optical system satisfy the following conditions.

$$-1.2 \leq \varphi 1/\varphi 2 \leq -0.9$$

$$-1.3 \leq \beta \leq -0.8$$

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention, and wherein.

DETAILED DESCRIPTION OF EMBODIMENTS

Hereinafter, one or more embodiments of the present invention will be described with reference to the drawings. However, the scope of the invention is not limited to the disclosed embodiments.

Figure 1:
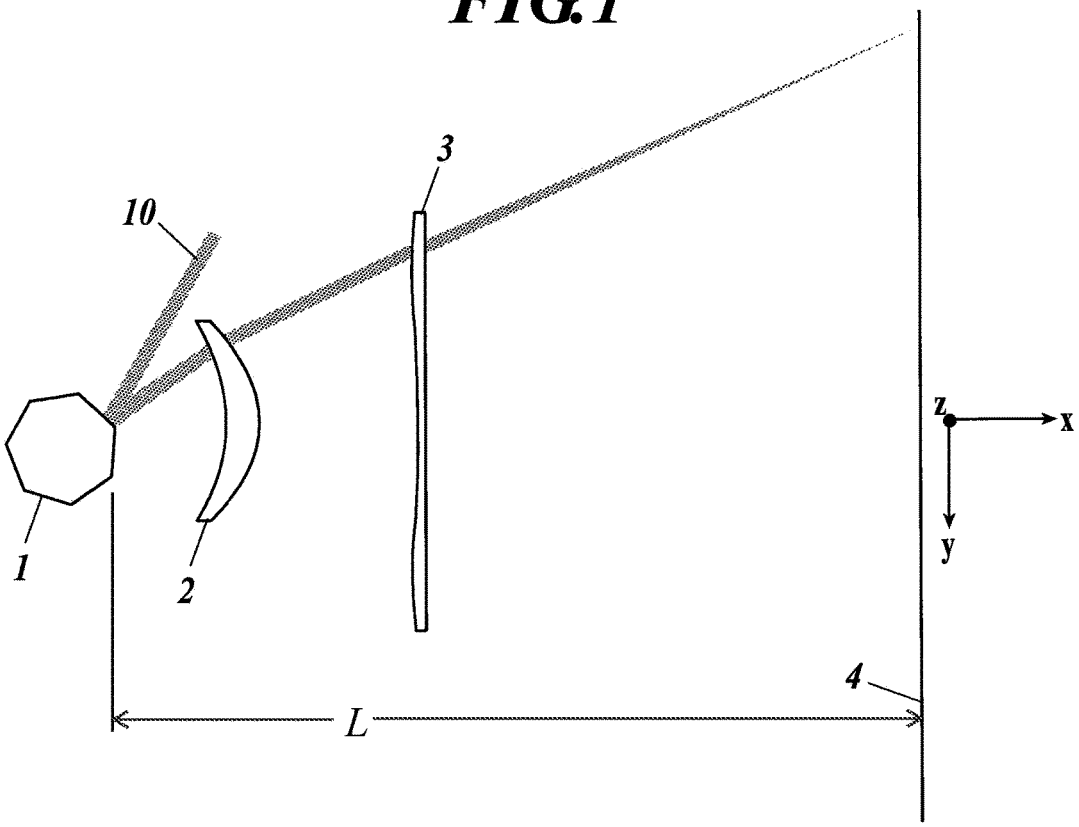
FIG. 1 illustrates the configuration of a scanning optical system according to an embodiment of the present invention.

FIG. 1 illustrates the scanning optical system of a scanning optical apparatus according to an embodiment of the present invention. The triaxial coordinate XYZ is shown in FIG. 1. A laser light 10 is emitted from a light source and collimated. The laser light 10 condensed in a sub scanning z direction (i.e. the direction normal to the sheet) enters a deflector 1, is deflected by the deflector 1, passes through a first lens 2 and a second lens 3, and is then incident on a scanning surface 4.

The scanning optical apparatus is applied to an image forming apparatus such as a printer or a copier that forms an image on a recording medium. The image forming apparatus includes an image carrier, a charger, the scanning optical apparatus, a developer, a transfer section and a fixation section.

The charger charges the image carrier, and the scanning optical apparatus emits a beam to the image carrier charged by the charger based on image data, so that an electrostatic latent image is formed on the image carrier. The image data may be based on external input data or data read by an original reader.

The developer applies a developing agent to the image carrier on which the electrostatic latent image is formed, so as to develop an image with the developing agent from the electrostatic latent image.

The transfer section transfers the developed image to a recording medium, and the fixation section heats and presses the transferred image to fix it on the recording medium.

In this way, the image forming apparatus forms an image on a recording medium.

Example 1 to Example 7, Example 1a to Example 6a and Example 1b to 5b of the present invention and Comparison 1 to Comparison 4 and Comparison 1a to Comparison 5a for comparison are all based on the scanning optical system as illustrated in FIG. 1 but have different configurations as listed in Table 4 to Table 9. The power ratio φ1/φ2, the magnification β in the sub scanning direction and the conjugation length L of these samples were calculated. The results are shown in Table 1 to 3. The conjugation length L is 373.2 mm in Example 1 to Example 7 and Comparison 1 to Comparison 4 as illustrated in Table 1, 405 mm in Example 1a to Example 6a, Comparison 1a, Comparison 2a, Comparison 4a and Comparison 5a, 410 nm in Comparison 3a, and 350 mm in Example 1b to Example 5b as illustrated in Table 2.

In all examples and comparisons, the maximum image height in the main scanning direction is 164.5 mm, the deflector 1 has a regular heptagonal shape with an inscribed circle diameter of φ48 mm, the incident angle to the deflector 1 is 60° with respect to the optical axis, the wavelength of the scanning beam is 780 nm, the ambient temperature is 25°, and the lens material of the first lens 2 and the second lens 3 is respectively ZEONEX 330R and ZEONEX E48R, the F number of the image plane is 47.6 in the main scanning y direction and 53.3 in the sub scanning z direction.

The planar aspect is determined by the following Expression 1.

$$x = \sum_i A_i y^i + z^2 \sum_i B_i y^i$$

In the expression, x is the direction of the optical axis, y is the main scanning direction perpendicular to the x direction, z is the sub scanning direction perpendicular to the x and y directions (corresponding to the triaxial coordinate in FIG. 1).

TABLE 1

| | POWER RATIO φ1/φ2 | MAGNIFICATION β | CONJUGATION LENGTH L |
|---|---|---|---|
| COMPARISON 1 | −1.2 | −1.4 | 373.2 |
| COMPARISON 2 | −1.4 | −1.3 | 373.2 |
| EXAMPLE 1 | −1.2 | −1.3 | 373.2 |
| EXAMPLE 2 | −1.2 | −1.15 | 373.2 |
| EXAMPLE 3 | −1.2 | −0.8 | 373.2 |
| EXAMPLE 4 | −1 | −1.3 | 373.2 |
| EXAMPLE 5 | −0.9 | −1.3 | 373.2 |
| EXAMPLE 6 | −1.05 | −1.15 | 373.2 |
| EXAMPLE 7 | −0.9 | −0.8 | 373.2 |
| COMPARISON 3 | −0.9 | −0.7 | 373.2 |
| COMPARISON 4 | −0.8 | −0.8 | 373.2 |

TABLE 2

| | POWER RATIO φ1/φ2 | MAGNIFICATION β | CONJUGATION LENGTH L |
|---|---|---|---|
| COMPARISON 1a | −1.2 | −1.4 | 405 |
| COMPARISON 2a | −1.4 | −1.3 | 405 |
| COMPARISON 3a | −1.2 | −1.3 | 410 |
| EXAMPLE 1a | −1.2 | −1.3 | 405 |
| EXAMPLE 2a | −1.2 | −1.15 | 405 |
| EXAMPLE 3a | −1.2 | −0.8 | 405 |
| EXAMPLE 4a | −1 | −1.3 | 405 |

TABLE 2-continued

| | POWER RATIO φ1/φ2 | MAGNIFICATION β | CONJUGATION LENGTH L |
|---|---|---|---|
| EXAMPLE 5a | −0.9 | −1.3 | 405 |
| EXAMPLE 6a | −0.9 | −0.8 | 405 |
| COMPARISON 4a | −0.9 | −0.7 | 405 |
| COMPARISON 5a | −0.8 | −0.8 | 405 |

TABLE 3

| | POWER RATIO φ1/φ2 | MAGNIFICATION β | CONJUGATION LENGTH L |
|---|---|---|---|
| EXAMPLE 1b | −1.2 | −1.3 | 350 |
| EXAMPLE 2b | −1.2 | −0.8 | 350 |
| EXAMPLE 3b | −0.9 | −1.3 | 350 |
| EXAMPLE 4b | −1.05 | −1.15 | 350 |
| EXAMPLE 5b | −0.9 | −0.8 | 350 |

TABLE 4

| DEGREE | EXAMPLE 1 | EXAMPLE 2 | EXAMPLE 3 | EXAMPLE 4 | EXAMPLE 5 | EXAMPLE 6 | EXAMPLE 7 | COMPARISON 1 | COMPARISON 2 | COMPARISON 3 | COMPARISON 4 |
|---|---|---|---|---|---|---|---|---|---|---|---|
| FIRST LENS, FIRST SURFACE, COEFFICIENT A | | | | | | | | | | | |
| 2 | −6.4688E−03 | −6.6166E−03 | −5.8000E−03 | −6.5713E−03 | −5.7971E−03 | −6.4688E−03 | −5.5992E−03 | −6.7629E−03 | −7.6277E−03 | −3.9199E−03 | −5.2368E−03 |
| 4 | −1.8055E−08 | −8.0709E−08 | 8.2706E−07 | −7.2757E−07 | −2.2413E−07 | −1.8055E−08 | 4.0891E−07 | −7.7733E−07 | −1.2795E−06 | 4.0098E−07 | 3.1847E−07 |
| 6 | −2.5336E−10 | −4.1320E−10 | −1.0333E−09 | −2.1138E−10 | −2.1565E−10 | −2.5336E−10 | −5.3926E−10 | −4.1102E−11 | −6.1560E−10 | −4.0864E−10 | −4.1360E−10 |
| 8 | −1.8679E−13 | −6.5924E−14 | 1.0239E−13 | −3.9348E−14 | −1.2142E−13 | −1.8679E−13 | −1.9384E−13 | −6.4676E−14 | 7.9534E−14 | −1.1108E−13 | −2.4910E−13 |
| 10 | 4.5605E−17 | 3.4677E−17 | 2.4193E−17 | 1.3958E−17 | 4.1763E−17 | 4.5605E−17 | 7.3536E−17 | 1.8291E−18 | −1.1139E−18 | 3.7785E−17 | 7.1313E−17 |
| FIRST LENS, FIRST SURFACE, COEFFICIENT B | | | | | | | | | | | |
| 0 | −2.7000E−02 | −2.7000E−02 | −2.7000E−02 | −2.7000E−02 | −2.7000E−02 | −2.7000E−02 | −2.7000E−02 | −2.7000E−02 | −2.7000E−02 | −2.7000E−02 | −2.7000E−02 |
| 1 | 1.7037E−04 | −4.0583E−04 | 3.6518E−03 | −5.0494E−04 | −2.7196E−04 | 1.7037E−04 | 8.2013E−04 | −2.3012E−04 | −1.9552E−04 | 3.6949E−03 | 6.3578E−04 |
| 2 | −1.6292E−05 | −1.8572E−05 | −3.3622E−06 | −9.2855E−06 | −3.4533E−06 | −1.6292E−05 | −2.4216E−06 | −1.2958E−05 | −1.2770E−05 | −4.4668E−05 | −1.3501E−05 |
| 3 | 1.5139E−07 | −6.8626E−08 | −3.0850E−07 | −1.8187E−07 | −3.8440E−08 | 1.5139E−07 | 1.9848E−07 | −3.1023E−08 | 4.6186E−08 | 4.6988E−07 | 3.2299E−08 |
| 4 | 1.5946E−08 | 9.0813E−09 | 2.4484E−08 | 1.8351E−08 | 1.8781E−08 | 1.5946E−08 | 8.5913E−09 | 2.3549E−08 | 1.8548E−08 | 2.6043E−08 | −7.6378E−09 |
| 5 | 1.5823E−11 | −2.2901E−11 | −1.0243E−09 | −1.7012E−10 | −2.7695E−11 | 1.5823E−11 | 3.9263E−11 | −9.1149E−11 | −1.8214E−11 | −5.7428E−10 | −1.7134E−11 |
| 6 | −9.7612E−12 | −1.0612E−11 | 5.5574E−12 | 1.1585E−12 | 2.4175E−12 | −9.7612E−12 | 1.4156E−12 | 5.6079E−12 | 1.4631E−11 | −6.6530E−13 | 3.5987E−12 |
| 7 | −2.1339E−14 | 3.7638E−14 | 3.4574E−13 | 1.7888E−14 | −1.1310E−14 | −2.1339E−14 | 1.2935E−13 | 1.6979E−14 | −1.0800E−14 | 3.7454E−13 | 1.9100E−13 |
| 8 | 5.3069E−15 | 2.5153E−15 | −4.0831E−15 | −1.1059E−15 | −3.2547E−15 | 5.3069E−15 | −8.2138E−15 | −2.6776E−15 | −4.4513E−15 | −6.4644E−15 | −1.4985E−14 |
| FIRST LENS, SECOND SURFACE, COEFFICIENT A | | | | | | | | | | | |
| 1 | 1.0270E−04 | 3.7149E−06 | 2.1495E−04 | 6.2392E−04 | 3.2586E−05 | 1.0270E−04 | 2.3620E−04 | −1.9213E−04 | −1.6091E−04 | −6.4434E−05 | 1.7265E−04 |
| 2 | −1.0090E−02 | −1.0294E−02 | −9.1960E−03 | −1.0328E−02 | −9.5084E−03 | −1.0090E−02 | −8.9500E−03 | −1.0780E−02 | −1.1636E−02 | −7.2911E−03 | −8.5881E−03 |
| 3 | −1.3791E−07 | −9.0041E−08 | −4.5044E−07 | −1.2438E−08 | 7.7583E−08 | −1.3791E−07 | −3.1346E−07 | 2.5240E−07 | 2.1499E−07 | −7.6177E−08 | −2.5968E−07 |
| 4 | −2.4290E−07 | −2.6768E−07 | 2.3464E−07 | −6.4196E−07 | −2.8997E−07 | −2.4290E−07 | −3.3121E−08 | −5.6945E−07 | −8.4699E−07 | 9.1664E−08 | −6.9730E−08 |
| 5 | 1.3903E−10 | 1.5218E−10 | 4.9865E−10 | −1.2395E−10 | 2.7673E−11 | 1.3903E−10 | 2.4997E−10 | 6.1631E−12 | 6.7737E−11 | 1.7781E−10 | 2.3964E−10 |
| 6 | −1.1870E−10 | −1.8417E−10 | −3.2065E−10 | −2.0347E−10 | −1.2701E−10 | −1.1870E−10 | −1.8860E−10 | −1.3566E−10 | −4.3721E−10 | −1.3960E−10 | −1.4750E−10 |
| 7 | −4.4228E−14 | −9.9147E−14 | −2.2886E−13 | −1.2942E−13 | −5.1983E−14 | −4.4228E−14 | −6.6780E−14 | −5.2075E−14 | −1.8914E−13 | −8.1642E−14 | −7.3920E−14 |
| 8 | −1.0020E−13 | −1.0931E−13 | −1.5338E−13 | −5.8122E−14 | −8.4511E−14 | −1.0020E−13 | −1.5219E−13 | −1.9866E−14 | −9.1310E−14 | −1.0869E−13 | −1.4186E−13 |
| 9 | −1.5630E−18 | 2.2472E−17 | 3.2875E−17 | 5.8534E−17 | 7.6411E−18 | −1.5630E−18 | −4.2787E−18 | 5.2431E−18 | 6.0560E−17 | 9.9610E−18 | −9.3087E−19 |
| 10 | −2.6421E−17 | −5.5359E−18 | 1.6016E−17 | −1.4550E−17 | −8.8329E−18 | −2.6421E−17 | −9.9882E−18 | −2.9011E−17 | −2.9906E−17 | −1.9785E−18 | −2.1704E−17 |
| FIRST LENS, SECOND SURFACE, COEFFICIENT B | | | | | | | | | | | |
| 0 | −1.0980E−02 | −8.9515E−03 | −1.0327E−02 | −1.1091E−02 | −1.2434E−02 | −1.0980E−02 | −1.3437E−02 | −7.4169E−03 | −4.5576E−03 | −1.3491E−02 | −1.4409E−02 |
| 1 | 1.0534E−04 | −2.3524E−04 | 2.0774E−03 | −2.9767E−04 | −1.5540E−04 | 1.0534E−04 | 4.5137E−04 | −1.3715E−04 | −1.1611E−04 | 2.0315E−03 | 3.4818E−04 |
| 2 | −8.1503E−06 | −8.9676E−06 | 2.6115E−05 | −4.5409E−06 | −2.8662E−06 | −8.1503E−06 | −2.2925E−07 | −6.3842E−06 | −5.6176E−06 | 2.1125E−05 | −6.2962E−06 |
| 3 | 6.5383E−08 | −5.9152E−08 | 6.6835E−07 | −1.3314E−07 | −5.6243E−08 | 6.5383E−08 | 1.6834E−07 | −4.2687E−08 | −7.7719E−09 | 7.0468E−07 | 6.1551E−08 |
| 4 | 1.1430E−09 | −4.1741E−10 | 1.1988E−09 | 4.0320E−09 | 4.7169E−09 | 1.1430E−09 | 1.2696E−09 | 4.6892E−09 | 4.0416E−09 | 7.0188E−09 | −5.1275E−09 |
| 5 | 3.2689E−11 | −2.5194E−11 | −2.7756E−10 | −1.0541E−10 | −3.0977E−11 | 3.2689E−11 | 7.3034E−11 | −4.4219E−11 | −1.5454E−11 | 1.3870E−10 | −1.1087E−11 |
| 6 | 6.9023E−16 | −1.7765E−12 | −8.7724E−12 | 2.1895E−12 | 2.1191E−12 | 6.9023E−16 | 1.9237E−12 | 3.5858E−12 | 4.4248E−12 | 5.6301E−12 | −7.3231E−13 |
| 7 | 6.2056E−16 | 6.3155E−15 | −1.8486E−13 | −3.0156E−14 | −1.1617E−14 | 6.2056E−16 | 5.4986E−14 | −1.5881E−14 | −5.6407E−15 | 1.9287E−13 | 3.5929E−14 |
| 8 | −5.8496E−16 | −6.3504E−16 | −8.5992E−16 | 6.3691E−16 | 1.2309E−15 | −5.8496E−16 | 6.8789E−16 | 1.1599E−15 | 1.4875E−15 | −8.4471E−18 | −3.2096E−16 |
| 9 | 4.8346E−18 | 1.5419E−18 | 8.8083E−17 | −2.4443E−17 | −6.7510E−18 | 4.8346E−18 | 8.7050E−18 | −7.8755E−18 | −4.0015E−18 | −7.3957E−17 | 6.6331E−18 |
| 10 | 6.2573E−19 | −2.1238E−19 | 1.5835E−18 | 2.4573E−19 | −4.3557E−18 | 6.2573E−19 | −1.9270E−18 | 2.6104E−19 | 1.0402E−18 | −2.1152E−18 | −2.3165E−18 |
| SECOND LENS, FIRST SURFACE, COEFFICIENT A | | | | | | | | | | | |
| 1 | 1.2252E−04 | −5.0720E−05 | 2.3272E−04 | 5.0852E−03 | 1.1104E−03 | 1.2252E−04 | 4.5541E−04 | −2.0880E−04 | −1.7429E−04 | −5.5076E−05 | 4.1735E−04 |
| 2 | −1.2568E−03 | −1.3388E−03 | −9.3709E−04 | −1.4050E−03 | −1.2138E−03 | −1.2568E−03 | −8.7096E−04 | −1.6969E−03 | −1.8706E−03 | −6.2086E−04 | −8.0895E−04 |
| 3 | −6.4626E−08 | −2.2051E−08 | −1.6329E−07 | −1.2346E−07 | 2.7246E−08 | −6.4626E−08 | −1.2070E−07 | 1.7312E−07 | 1.6721E−07 | −6.2504E−09 | −9.0443E−08 |
| 4 | 2.6933E−07 | 3.0441E−07 | 1.5751E−07 | 3.1412E−07 | 2.7135E−07 | 2.6933E−07 | 1.2603E−07 | 4.6136E−07 | 4.8925E−07 | 8.2835E−08 | 1.0813E−07 |

TABLE 4-continued

| DEGREE | EXAMPLE 1 | EXAMPLE 2 | EXAMPLE 3 | EXAMPLE 4 | EXAMPLE 5 | EXAMPLE 6 | EXAMPLE 7 | COMPARISON 1 | COMPARISON 2 | COMPARISON 3 | COMPARISON 4 |
|---|---|---|---|---|---|---|---|---|---|---|---|
| 5 | 2.0263E−11 | 1.0208E−11 | 4.0853E−11 | −5.7486E−11 | −1.5544E−11 | 2.0263E−11 | 2.2165E−11 | −3.9600E−11 | −4.9154E−11 | 3.6510E−12 | 1.5832E−11 |
| 6 | −2.6847E−11 | −3.3689E−11 | −1.3968E−11 | −3.1231E−11 | −2.6914E−11 | −2.6847E−11 | −9.3610E−12 | −5.2034E−11 | −5.8355E−11 | −4.7927E−12 | −6.3410E−12 |
| 7 | −2.7894E−15 | −1.7367E−15 | −4.3723E−15 | 1.1257E−14 | 1.9393E−15 | −2.7894E−15 | −1.8133E−15 | 3.9658E−15 | 5.8177E−15 | −1.9041E−16 | −1.1146E−15 |
| 8 | 1.8983E−15 | 2.7992E−15 | 9.0368E−16 | 2.3644E−15 | 1.9967E−15 | 1.8983E−15 | 5.1644E−16 | 3.6633E−15 | 5.1789E−15 | 1.8264E−16 | 2.2141E−16 |
| 9 | 1.2954E−19 | 1.0222E−19 | 1.6363E−19 | −6.3539E−19 | −1.0585E−19 | 1.2954E−19 | 4.7675E−20 | −1.7270E−19 | −2.4320E−19 | −1.9745E−21 | 1.9218E−20 |
| 10 | −6.1478E−20 | −1.1160E−18 | −2.4479E−20 | −9.0095E−20 | −7.4730E−20 | −6.1478E−20 | −1.1544E−20 | −1.1073E−19 | −2.3600E−19 | −1.9234E−21 | −7.9017E−22 |
| SECOND LENS, FIRST SURFACE, COEFFICIENT B | | | | | | | | | | | |
| 0 | 1.2005E−02 | 1.2551E−02 | 1.1163E−02 | 1.2471E−02 | 1.2050E−02 | 1.2005E−02 | 1.0700E−02 | 1.4099E−02 | 1.4558E−02 | 1.0627E−02 | 1.0567E−02 |
| 1 | 3.4330E−06 | −7.1749E−06 | 3.1962E−05 | −1.2464E−05 | −5.9436E−06 | 3.4330E−06 | 6.3587E−06 | −6.3794E−06 | −4.6711E−06 | 2.3121E−05 | 4.8429E−06 |
| 2 | −2.7826E−07 | −3.7064E−07 | −2.5684E−07 | −2.5940E−07 | −2.0389E−07 | −2.7826E−07 | −1.2996E−07 | −4.4238E−07 | −4.8085E−07 | −2.2678E−07 | −1.6381E−07 |
| 3 | −2.2488E−10 | 1.2564E−09 | −5.1622E−09 | 1.7553E−09 | 9.0267E−10 | −2.2488E−10 | −5.3905E−10 | 1.2070E−09 | 1.5444E−08 | −1.6295E−09 | −4.6931E−10 |
| 4 | −5.2367E−11 | −5.1995E−11 | −7.6783E−12 | −4.7064E−11 | −4.5120E−11 | −5.2367E−11 | −2.6093E−11 | −6.6033E−11 | −7.2859E−11 | −8.4037E−12 | −2.1480E−11 |
| 5 | −2.2805E−14 | −4.1177E−14 | 3.3774E−13 | −2.7946E−14 | 6.7343E−15 | −2.2805E−14 | 4.3864E−14 | −4.0818E−14 | −1.2705E−13 | 3.3682E−14 | 2.4752E−14 |
| 6 | 1.0407E−14 | 9.2574E−15 | 3.7464E−15 | 2.8415E−15 | 5.4244E−15 | 1.0407E−14 | 5.5246E−15 | 8.4130E−15 | 8.2037E−15 | 4.4053E−15 | 4.0918E−15 |
| 7 | 5.8454E−18 | −7.2279E−18 | −1.1523E−17 | −1.3909E−17 | −1.3898E−17 | 5.8454E−18 | −2.8512E−18 | −5.1735E−18 | −1.3458E−17 | 4.0877E−19 | 1.7566E−18 |
| 8 | −8.3698E−19 | −5.7025E−19 | −5.1872E−19 | 2.8562E−19 | −5.6903E−19 | −8.3698E−19 | −6.6173E−19 | −6.0555E−19 | −4.9957E−19 | −5.7716E−19 | −4.4034E−19 |
| 9 | −4.5831E−22 | 6.2562E−22 | 3.2746E−22 | 1.1693E−21 | 1.1152E−21 | −4.5831E−22 | 7.3067E−23 | 9.2862E−23 | 2.1908E−21 | 1.3129E−23 | −2.0835E−22 |
| 10 | 1.8764E−23 | 9.3699E−24 | 2.5403E−23 | −2.5273E−23 | 4.5096E−23 | 1.8764E−23 | 3.1675E−23 | 6.2309E−23 | 6.6453E−23 | 2.5877E−23 | 2.0037E−23 |

THE SECOND SURFACE OF THE SECOND LENS IS FLAT IN ALL EXAMPLES AND COMPARISONS

TABLE 5

| DISTANCE TO NEXT SURFACE AND EFFECTIVE LENGTH OF SECOND LENS (UNIT: mm) | | | | | | | | | | | |
|---|---|---|---|---|---|---|---|---|---|---|---|
| | EXAMPLE 1 | EXAMPLE 2 | EXAMPLE 3 | EXAMPLE 4 | EXAMPLE 5 | EXAMPLE 6 | EXAMPLE 7 | COMPARISON 1 | COMPARISON 2 | COMPARISON 3 | COMPARISON 4 |
| DEFLECTOR SURFACE | 56.36 | 56.36 | 56.36 | 56.36 | 56.36 | 56.36 | 56.36 | 56.36 | 56.36 | 56.36 | 56.36 |
| L1S1 | 14.5 | 14.5 | 14.5 | 14.5 | 14.5 | 14.5 | 14.5 | 14.5 | 14.5 | 14.5 | 14.5 |
| L1S2 | 56.19 | 66.87 | 98.78 | 62.03 | 65.02 | 71.14 | 108.82 | 49.91 | 50.60 | 120.07 | 112.21 |
| L2S1 | 4 | 4 | 4 | 4 | 4 | 4 | 4 | 4 | 4 | 4 | 4 |
| L2S2 | 242.149 | 231.466 | 199.556 | 236.307 | 233.324 | 227.200 | 189.520 | 248.427 | 247.739 | 178.265 | 186.128 |
| EFFECTIVE LENGTH | 135.93 | 144.7 | 167.86 | 140.76 | 143.25 | 148.17 | 178.53 | 131.07 | 131.4 | 188.14 | 181.26 |

L1, L2 DENOTE THE FIRST AND SECOND LENSES, AND S1, S2 DENOTE THE FIRST AND SECOND SURFACES

TABLE 6

| DEGREE | EXAMPLE 1a | EXAMPLE 2a | EXAMPLE 3a | EXAMPLE 4a | EXAMPLE 5a | EXAMPLE 6a | COMPARISON 1a | COMPARISON 2a | COMPARISON 3a | COMPARISON 4a | COMPARISON 5a |
|---|---|---|---|---|---|---|---|---|---|---|---|
| FIRST LENS, FIRST SURFACE, COEFFICIENT A | | | | | | | | | | | |
| 2 | −7.0703E−03 | −7.0017E−03 | −6.2933E−03 | −7.9183E−03 | −7.6016E−03 | −6.2446E−03 | −7.8374E−03 | −7.8678E−03 | −7.1050E−03 | −5.4559E−03 | −6.2871E−03 |
| 4 | −1.3998E−07 | −1.2375E−07 | −2.7567E−08 | −6.3231E−07 | −4.0234E−07 | 4.7887E−09 | −5.6946E−07 | −1.1310E−05 | 1.9470E−07 | −5.5783E−08 | −2.4841E−08 |
| 6 | −1.5329E−10 | −2.7531E−10 | −5.1939E−10 | −5.7412E−10 | −8.0881E−10 | −6.9993E−10 | 3.9054E−11 | −6.0058E−10 | −2.0047E−10 | −5.3934E−10 | −7.0834E−10 |
| 8 | −7.3311E−14 | −1.7035E−13 | −4.6555E−13 | −6.4399E−13 | −2.7790E−13 | −2.2690E−13 | −2.7605E−13 | 2.8864E−13 | −1.7560E−13 | −2.2400E−13 | −4.3117E−13 |
| 10 | −2.1724E−17 | 6.7149E−17 | 2.2543E−16 | 2.4719E−16 | 1.3923E−16 | 1.3368E−16 | 4.8814E−17 | −8.8488E−17 | 1.8639E−16 | 6.7708E−17 | 1.8462E−16 |
| FIRST LENS, FIRST SURFACE, COEFFICIENT B | | | | | | | | | | | |
| 0 | −2.7000E−02 | −2.7000E−02 | −2.7000E−02 | −2.7000E−02 | −2.7000E−02 | −2.7000E−02 | −2.7000E−02 | −2.7000E−02 | −2.7000E−02 | −2.7000E−02 | −2.7000E−02 |
| 1 | 3.1544E−04 | 7.1382E−04 | 2.7748E−04 | 1.4886E−04 | 1.3640E−04 | 1.1169E−03 | −3.2787E−04 | 1.5775E−04 | 1.1670E−03 | 2.5707E−03 | 6.6672E−04 |
| 2 | −1.6417E−05 | −2.1122E−05 | 1.2755E−05 | −1.8311E−05 | −1.7791E−05 | 2.2198E−07 | −1.6980E−05 | −2.8963E−05 | −2.5124E−05 | −1.5056E−05 | 1.2938E−05 |
| 3 | 2.0740E−07 | 3.3016E−07 | 1.3246E−07 | 1.0446E−07 | 8.3799E−08 | 1.7990E−07 | −2.3307E−07 | 1.6566E−07 | 8.6956E−08 | 5.3227E−08 | −5.7119E−07 |
| 4 | 4.3706E−09 | −2.4880E−09 | −1.0058E−08 | 2.0328E−08 | 1.7234E−08 | −1.5101E−08 | 7.8965E−09 | 2.5262E−08 | 3.9678E−08 | −1.0312E−08 | 5.5017E−09 |
| 5 | −1.1317E−10 | −1.0899E−10 | 2.5668E−10 | −6.6091E−11 | −6.4106E−11 | 2.0666E−10 | −2.5297E−10 | −3.0580E−10 | 9.1927E−11 | 2.1181E−10 | −3.8877E−10 |
| 6 | −1.6077E−11 | −3.4501E−11 | 4.0109E−11 | 5.8621E−12 | 7.9498E−12 | 3.9660E−11 | −3.9587E−12 | 2.9516E−11 | −6.7736E−11 | 2.9177E−11 | 6.9778E−11 |
| 7 | −4.4539E−13 | −3.2319E−13 | −1.0794E−13 | 2.1390E−14 | 1.8102E−14 | 1.6622E−13 | −4.9572E−13 | −1.0628E−13 | −8.8275E−13 | 2.4110E−13 | 3.3624E−13 |
| 8 | 3.9085E−15 | 2.5076E−14 | −1.7676E−14 | −1.5928E−15 | −2.8199E−15 | −2.2303E−14 | −1.1323E−14 | −2.9724E−14 | 2.6674E−14 | −1.8580E−14 | −3.4213E−14 |
| FIRST LENS, SECOND SURFACE, COEFFICIENT A | | | | | | | | | | | |
| 1 | 5.3293E−05 | 1.5223E−04 | 3.9543E−04 | 1.9570E−04 | 1.3363E−04 | 3.6141E−04 | 7.4886E−05 | −1.3614E−04 | 2.0513E−03 | 1.2161E−04 | 3.1680E−04 |
| 2 | −1.0319E−02 | −1.0123E−02 | −9.1893E−03 | −1.0989E−02 | −1.0653E−02 | −8.1101E−03 | −1.1172E−02 | −1.1184E−02 | −1.0028E−02 | −8.3384E−03 | −9.1384E−03 |
| 3 | −8.9241E−08 | −1.1707E−07 | −1.7512E−07 | −9.5713E−08 | −1.3178E−07 | −2.3660E−07 | −2.0038E−08 | 1.2819E−07 | −1.1488E−07 | −1.7646E−07 | −2.6298E−07 |
| 4 | −3.0127E−07 | −3.4072E−07 | −3.2127E−07 | −6.8882E−07 | −5.4540E−07 | −3.1973E−07 | −5.6438E−07 | −9.3632E−07 | −7.0543E−08 | −3.1940E−07 | −3.4977E−07 |
| 5 | 1.4092E−10 | 5.2023E−11 | 5.1080E−11 | 1.1148E−10 | 2.0441E−10 | 1.7618E−10 | −5.1481E−12 | 7.2175E−11 | −1.1081E−10 | 2.2444E−10 | 2.3290E−10 |
| 6 | −8.7146E−11 | −1.4169E−10 | −2.4783E−10 | −3.3582E−10 | −3.9331E−10 | −3.2080E−10 | −7.7607E−11 | −3.9198E−10 | −9.5582E−11 | −2.5431E−10 | −3.2395E−10 |
| 7 | −6.8854E−14 | 1.5956E−14 | 1.3059E−13 | −4.5660E−16 | −1.0072E−13 | −5.0161E−15 | 2.1762E−14 | −1.9422E−13 | 3.7048E−13 | −1.0896E−13 | −3.6734E−14 |
| 8 | −2.5287E−14 | −1.0785E−13 | −2.3504E−13 | −2.7478E−13 | −2.1192E−13 | −1.6792E−13 | −6.4321E−14 | −1.9829E−14 | −5.1716E−14 | −1.3366E−13 | −2.2430E−13 |
| 9 | 7.2146E−18 | −1.5520E−17 | −7.9370E−17 | −2.7071E−17 | 7.8128E−18 | −3.3488E−17 | −1.1532E−17 | 7.0971E−17 | −2.6409E−16 | 1.3091E−17 | −2.5826E−17 |
| 10 | −4.3592E−17 | −2.7904E−18 | 1.8814E−17 | −3.5056E−17 | −1.5527E−17 | 1.9479E−18 | −4.1519E−17 | −1.9218E−17 | 1.3357E−17 | −2.4849E−17 | −1.2706E−17 |
| FIRST LENS, SECOND SURFACE, COEFFICIENT B | | | | | | | | | | | |
| 0 | −9.6497E−03 | −1.0325E−02 | −1.1391E−02 | −1.2202E−02 | −1.3360E−02 | −1.4149E−02 | −9.1361E−03 | −6.7261E−03 | −9.8368E−03 | −1.4174E−02 | −1.5018E−02 |
| 1 | 1.9267E−04 | 4.1711E−04 | 1.5407E−04 | 9.0160E−05 | 8.1598E−05 | 5.9724E−04 | −1.8891E−04 | 1.0645E−04 | 6.8694E−04 | 1.3703E−03 | 3.5125E−04 |
| 2 | −7.8860E−06 | −8.6702E−06 | 4.7038E−06 | −9.1473E−06 | −9.2153E−06 | 2.1055E−05 | −7.8551E−06 | −1.3673E−05 | −6.9734E−06 | 1.1913E−05 | 5.0803E−06 |
| 3 | 9.7706E−08 | 1.5529E−07 | 1.0505E−07 | 3.9600E−08 | 3.1575E−08 | 2.3801E−07 | −1.1639E−07 | 4.8299E−08 | 1.0213E−07 | 4.4418E−07 | −6.1011E−08 |
| 4 | −1.7524E−09 | −3.8488E−09 | −5.7011E−10 | 2.9230E−08 | 2.1886E−09 | −3.3521E−09 | −1.9107E−10 | 5.2573E−09 | 3.5221E−09 | −4.8765E−09 | 2.0708E−09 |
| 5 | −6.3375E−12 | 1.3274E−11 | 7.8341E−11 | 1.1188E−11 | 5.8357E−12 | 3.9870E−11 | −1.1200E−10 | −4.3755E−11 | 7.1991E−11 | −4.8127E−11 | −1.7535E−10 |
| 6 | −2.5226E−12 | −6.2518E−12 | 4.1924E−12 | 2.5517E−12 | 2.3761E−12 | 4.4023E−12 | −6.5171E−13 | 4.1811E−12 | −5.5173E−12 | 6.1316E−12 | 1.2313E−11 |
| 7 | −7.3343E−14 | −1.3141E−13 | 4.4143E−14 | 5.2314E−15 | 6.0079E−15 | 1.3764E−13 | −7.6620E−14 | 2.0753E−14 | −1.5620E−13 | 2.6503E−13 | 1.0172E−13 |
| 8 | −2.6122E−15 | −2.4158E−15 | 4.8586E−15 | 2.1243E−16 | 3.4290E−16 | 3.6765E−15 | −1.0372E−15 | 3.5321E−15 | −5.6533E−15 | 2.3351E−15 | 5.3014E−15 |
| 9 | −5.5719E−17 | 1.6798E−17 | 1.4156E−17 | 6.7930E−18 | 3.3501E−18 | 3.7587E−17 | −8.1610E−17 | −6.8239E−17 | −1.0675E−16 | 3.9763E−18 | −4.9783E−17 |
| 10 | 5.8774E−19 | 2.4462E−18 | −1.4088E−18 | 6.9834E−19 | 4.3519E−19 | −2.1384E−18 | −1.2050E−18 | −4.1273E−18 | 1.4000E−18 | −1.9040E−18 | 8.8674E−19 |
| SECOND LENS, FIRST SURFACE, COEFFICIENT A | | | | | | | | | | | |
| 1 | 9.5456E−05 | 2.1943E−04 | 7.1181E−04 | 1.4059E−04 | 5.1148E−05 | 6.0050E−04 | 1.8342E−04 | −1.4759E−04 | 3.4989E−03 | 2.5256E−04 | 5.6424E−04 |
| 2 | −1.1814E−03 | −1.0504E−03 | −6.7169E−04 | −1.1260E−03 | −1.0440E−03 | −6.4142E−04 | −1.4207E−03 | −1.4074E−03 | −7.1026E−04 | −5.2816E−04 | −6.3927E−04 |
| 3 | −3.5702E−08 | −5.8543E−08 | −9.3120E−08 | −6.3279E−08 | −6.1305E−08 | −9.8447E−08 | −1.6315E−08 | 9.8911E−08 | −2.8715E−07 | −4.8938E−08 | −9.8565E−08 |

TABLE 6-continued

| DEGREE | EXAMPLE 1a | EXAMPLE 2a | EXAMPLE 3a | EXAMPLE 4a | EXAMPLE 5a | EXAMPLE 6a | COMPAR-ISON 1a | COMPAR-ISON 2a | COMPAR-ISON 3a | COMPAR-ISON 4a | COMPAR-ISON 5a |
|---|---|---|---|---|---|---|---|---|---|---|---|
| 4 | 2.7041E−07 | 2.1163E−07 | 1.0497E−07 | 2.5119E−07 | 2.2643E−07 | 8.8182E−08 | 3.5484E−07 | 3.1303E−07 | 2.3815E−07 | 6.1352E−08 | 8.3485E−08 |
| 5 | 1.3215E−11 | 1.1655E−11 | 1.5767E−11 | 2.4140E−11 | 2.5672E−11 | 1.6579E−11 | −9.3436E−13 | −2.6165E−11 | 2.7828E−11 | 7.9279E−12 | 1.6751E−11 |
| 6 | −2.4478E−11 | −2.0503E−11 | −9.4096E−12 | −2.9538E−11 | −2.5657E−11 | −6.4643E−12 | −3.8938E−11 | −2.8765E−11 | −2.6126E−11 | −2.4239E−12 | −5.5957E−12 |
| 7 | −1.9023E−15 | −1.2379E−15 | −1.2360E−15 | −4.3042E−15 | −4.5824E−15 | −1.3128E−15 | 7.4230E−16 | 2.3590E−15 | −4.0352E−17 | −4.6492E−16 | −1.2320E−15 |
| 8 | 1.2258E−15 | 1.6458E−15 | 7.5029E−16 | 2.8906E−15 | 2.4281E−15 | 4.1980E−16 | 2.9300E−15 | 1.9359E−15 | 2.2885E−15 | 2.4133E−17 | 2.9824E−16 |
| 9 | 7.8447E−20 | 4.5230E−20 | 2.0297E−20 | 2.4544E−19 | 2.6826E−19 | 2.7406E−20 | −8.9311E−20 | −4.4274E−20 | −4.7395E−19 | 2.7278E−21 | 2.1547E−20 |
| 10 | −1.2626E−20 | −6.7428E−20 | −2.6358E−20 | −1.2962E−19 | −1.0470E−19 | −1.1943E−20 | −1.0589E−19 | −6.2654E−20 | −1.4973E−19 | 2.7751E−21 | −5.7531E−21 |
| SECOND LENS, FIRST SURFACE, COEFFICIENT B | | | | | | | | | | | |
| 0 | 1.1846E−02 | 1.1165E−02 | 1.0089E−02 | 1.1125E−02 | 1.0803E−02 | 9.7416E−03 | 1.2364E−02 | 1.2682E−02 | 1.1657E−02 | 9.7085E−03 | 9.6438E−03 |
| 1 | 6.2456E−06 | 8.9631E−06 | 1.5014E−06 | 2.9029E−06 | 2.5473E−06 | 6.2745E−06 | −6.6336E−06 | 4.2328E−06 | 1.9812E−05 | 1.1657E−05 | 3.4775E−06 |
| 2 | −3.3486E−07 | −2.9232E−07 | −1.1536E−07 | −2.7762E−07 | −2.5733E−07 | −1.1905E−07 | −3.7025E−07 | −5.2896E−07 | −4.0110E−07 | −1.2936E−07 | −8.5312E−08 |
| 3 | −6.5147E−10 | −1.0953E−09 | −2.2150E−11 | −5.5790E−10 | −4.8959E−10 | −5.1004E−10 | 4.6442E−10 | −1.1091E−09 | −3.8579E−09 | −9.1865E−10 | −6.9569E−10 |
| 4 | −6.1682E−11 | −4.6556E−11 | −1.8227E−11 | −1.6199E−11 | −1.5033E−11 | −1.3903E−11 | −6.8626E−11 | 3.6316E−11 | −5.8360E−11 | −1.2512E−11 | −1.1052E−11 |
| 5 | −2.0425E−13 | −5.6389E−14 | 1.3140E−14 | 6.0417E−14 | 5.7907E−14 | 3.8858E−14 | −2.1745E−13 | −2.0701E−14 | 1.2332E−13 | 5.3129E−14 | 1.6268E−14 |
| 6 | 9.1796E−15 | 7.7121E−15 | 3.1269E−15 | 4.7728E−15 | 4.7951E−15 | 2.8209E−15 | 8.7123E−15 | −4.2422E−15 | 1.3784E−14 | 3.1924E−15 | 2.7734E−15 |
| 7 | 2.4441E−17 | 7.0651E−18 | −2.7327E−18 | −2.0768E−18 | −3.3475E−18 | −1.9329E−18 | 1.9732E−17 | 2.2306E−17 | 4.1172E−17 | −2.8271E−18 | 6.2746E−18 |
| 8 | −5.4180E−20 | −2.7267E−19 | −2.7643E−19 | −8.0916E−19 | −8.6161E−19 | −2.9382E−19 | −6.5774E−20 | −2.4169E−18 | −8.1329E−19 | −3.5280E−19 | −3.2775E−19 |
| 9 | −2.0002E−22 | 2.9626E−22 | 1.5319E−22 | −1.3361E−22 | 4.4744E−23 | 2.0550E−23 | 8.9096E−22 | −8.9375E−22 | −6.8796E−21 | 9.6139E−23 | −4.4534E−22 |
| 10 | −5.4116E−23 | −1.2232E−23 | 9.6644E−24 | 6.4261E−23 | 5.6779E−23 | 1.2330E−23 | −2.8658E−23 | 4.5315E−22 | −4.4232E−23 | 1.4803E−23 | 1.3731E−23 |

TABLE 7

| | EXAMPLE 1a | EXAMPLE 2a | EXAMPLE 3a | EXAMPLE 4a | EXAMPLE 5a | EXAMPLE 6a | COMPARISON 1a | COMPARISON 2a | COMPARISON 3a | COMPARISON 4a | COMPARISON 5a |
|---|---|---|---|---|---|---|---|---|---|---|---|
| DEFLECTOR SURFACE | 56.36 | 56.36 | 56.36 | 56.36 | 56.36 | 56.36 | 56.36 | 56.36 | 56.36 | 56.36 | 56.36 |
| L1S1 | 14.5 | 14.5 | 14.5 | 14.5 | 14.5 | 14.5 | 14.5 | 14.5 | 14.5 | 14.5 | 14.5 |
| L1S2 | 68.64 | 80.35 | 116.44 | 74.93 | 78.18 | 126.29 | 61.83 | 62.68 | 70.13 | 138.92 | 129.95 |
| L2S1 | 4 | 4 | 4 | 4 | 4 | 4 | 4 | 4 | 4 | 4 | 4 |
| L2S2 | 261.503 | 249.786 | 218.705 | 255.206 | 251.964 | 203.849 | 268.310 | 267.459 | 260.013 | 191.216 | 200.195 |
| EFFECTIVE LENGTH | 134.7 | 140.1 | 171.6 | 140.1 | 142.7 | 179.0 | 129.4 | 129.8 | 138.3 | 188.8 | 181.5 |

TABLE 8

| DEGREE | EXAMPLE 1b | EXAMPLE 2b | EXAMPLE 3b | EXAMPLE 4b | EXAMPLE 5b |
|---|---|---|---|---|---|
| FIRST LENS, FIRST SURFACE, COEFFICIENT A | | | | | |
| 2 | −5.7230E−03 | −4.7568E−03 | −5.5770E−03 | −4.9925E−03 | −4.4385E−03 |
| 4 | −1.1213E−06 | 3.8792E−07 | 3.0858E−07 | 6.1012E−07 | 3.2632E−07 |
| 6 | 3.6955E−10 | −1.4117E−10 | 3.4918E−10 | 3.5997E−10 | −6.6447E−11 |
| 8 | 1.2006E−13 | −2.0478E−14 | −6.4221E−16 | −7.8773E−15 | −3.9094E−14 |
| 10 | −1.4577E−17 | 8.5618E−19 | 3.5734E−19 | 3.3476E−18 | 3.4039E−18 |
| FIRST LENS, FIRST SURFACE, COEFFICIENT B | | | | | |
| 0 | −2.7000E−02 | −2.7000E−02 | −2.7000E−02 | −2.7000E−02 | −2.7000E−02 |
| 1 | −6.7389E−05 | 1.2596E−03 | −5.7083E−05 | 2.3942E−04 | 4.7516E−04 |
| 2 | −1.3558E−05 | −1.0027E−05 | 1.5776E−05 | 3.5475E−05 | −1.2733E−05 |
| 3 | 1.0812E−07 | −2.9616E−07 | −1.2844E−07 | −1.0141E−07 | −1.7142E−07 |
| 4 | 1.3360E−08 | 6.2733E−10 | −5.4361E−08 | −7.7861E−08 | −3.9718E−08 |
| 5 | −7.5221E−12 | 1.0850E−10 | 1.0615E−10 | 2.7623E−10 | 2.1380E−10 |
| 6 | 1.9824E−11 | 1.1985E−12 | 7.5905E−12 | 1.0513E−11 | 6.0629E−12 |
| 7 | −1.7050E−15 | −5.1228E−14 | 1.5117E−14 | −4.9164E−14 | −1.7186E−13 |
| 8 | −5.8621E−15 | −8.0571E−16 | 4.0254E−15 | 4.3625E−15 | 6.7231E−15 |
| FIRST LENS, SECOND SURFACE, COEFFICIENT A | | | | | |
| 1 | −1.7792E−04 | 7.0752E−05 | 4.3839E−05 | 6.5303E−05 | 7.8164E−05 |
| 2 | −1.03196−02 | −8.6479E−03 | −9.9325E−03 | −9.2166E−03 | −8.2643E−03 |
| 3 | 5.0791E−07 | −1.5164E−07 | −4.0974E−08 | −7.1894E−08 | −1.1882E−07 |
| 4 | −7.4525E−07 | 4.6364E−08 | 1.2797E−07 | 3.2530E−07 | 8.0137E−09 |
| 5 | −2.7677E−10 | 1.4445E−10 | 3.1469E−11 | 3.7476E−11 | 9.1712E−11 |
| 6 | −1.2641E−12 | −1.6030E−11 | 2.0150E−10 | 2.5741E−10 | 2.1885E−12 |
| 7 | 3.7864E−14 | −5.5746E−14 | −2.9676E−15 | −1.8995E−15 | −2.8939E−14 |
| 8 | 5.3564E−14 | −2.4525E−14 | 7.1139E−14 | 7.2791E−14 | −1.6778E−14 |
| 9 | −1.7897E−18 | 6.3562E−18 | −3.8814E−18 | −3.4267E−18 | 1.5860E−18 |
| 10 | 4.2874E−17 | −1.0871E−17 | 4.3371E−18 | 4.7542E−18 | −1.0998E−17 |
| FIRST LENS, SECOND SURFACE, COEFFICIENT B | | | | | |
| 0 | −6.6198E−03 | −9.3733E−03 | −1.1593E−02 | −9.9915E−03 | −1.2811E−02 |
| 1 | −3.4332E−05 | 7.4286E−04 | −3.1277E−05 | 1.4599E−04 | 2.7290E−04 |
| 2 | −7.2203E−06 | −8.5774E−08 | 6.8274E−06 | 1.7141E−05 | −6.4777E−06 |
| 3 | 3.1161E−08 | 4.5871E−08 | −5.6385E−08 | 6.1816E−08 | −2.6184E−08 |
| 4 | 2.6501E−09 | −4.0945E−09 | −1.5180E−08 | −1.8077E−08 | −1.5486E−08 |
| 5 | 7.3148E−12 | −2.6994E−11 | −3.1564E−12 | −1.6826E−11 | −2.9902E−11 |
| 6 | 3.9106E−12 | −3.2906E−13 | −1.2414E−11 | −2.2308E−11 | −3.7678E−12 |
| 7 | 4.3386E−15 | 2.5731E−14 | 4.7316E−14 | 2.5134E−14 | 1.6184E−14 |
| 8 | 2.4103E−15 | 4.0979E−16 | 5.2011E−15 | 1.0499E−14 | 3.1748E−15 |
| 9 | 5.0622E−18 | −1.0574E−17 | −9.5083E−18 | −5.1969E−18 | −1.1790E−17 |
| 10 | 6.7143E−19 | −3.1192E−19 | 1.2085E−19 | −4.2798E−19 | −2.0365E−19 |
| SECOND LENS, FIRST SURFACE, COEFFICIENT A | | | | | |
| 1 | 1.6742E−04 | 8.6342E−05 | 1.4269E−04 | 1.4279E−04 | 1.5846E−04 |
| 2 | −2.0159E−03 | −1.1718E−03 | −1.7485E−03 | −1.5127E−03 | −1.0672E−03 |
| 3 | 2.8122E−07 | −5.8570E−08 | −2.5092E−08 | −3.9967E−08 | −4.8509E−08 |
| 4 | 4.8320E−07 | 1.7804E−07 | 4.3230E−07 | 3.4999E−07 | 1.4325E−07 |
| 5 | −9.8581E−11 | 1.3967E−11 | 6.1858E−12 | 8.6816E−12 | 9.3935E−12 |
| 6 | −4.3024E−11 | −1.1966E−11 | −4.6372E−11 | −3.3917E−11 | −8.2518E−12 |
| 7 | 1.4602E−14 | −1.4026E−15 | −6.2229E−16 | 7.8287E−16 | −8.1974E−16 |
| 8 | 1.7598E−15 | 5.0770E−16 | 3.1007E−15 | 2.0583E−15 | 2.9717E−16 |
| 9 | −8.6826E−19 | 4.8696E−20 | 5.6334E−21 | 1.3004E−20 | 2.4186E−20 |
| 10 | −2.4221E−21 | −8.6343E−21 | −9.8773E−20 | −5.9762E−20 | −3.9970E−21 |
| SECOND LENS, FIRST SURFACE, COEFFICIENT B | | | | | |
| 0 | 1.4903E−02 | 1.2125E−02 | 1.3181E−02 | 1.3144E−02 | 1.1542E−02 |
| 1 | −1.1436E−06 | 1.4261E−05 | −1.6351E−06 | 5.1589E−06 | 4.9807E−06 |
| 2 | −4.4295E−07 | −2.0490E−07 | 2.0220E−07 | 3.0207E−07 | −1.9230E−07 |
| 3 | 8.3231E−10 | −2.7955E−09 | 2.9579E−10 | −5.8052E−10 | −9.0595E−10 |

TABLE 8-continued

| DEGREE | EXAMPLE 1b | EXAMPLE 2b | EXAMPLE 3b | EXAMPLE 4b | EXAMPLE 5b |
|---|---|---|---|---|---|
| 4 | −7.0535E−11 | −4.4067E−11 | −5.6113E−10 | −5.5379E−10 | −5.5758E−11 |
| 5 | −7.2202E−14 | 3.3640E−13 | −2.0550E−14 | 1.0110E−13 | 1.5809E−13 |
| 6 | 7.5491E−15 | 7.4997E−15 | 1.5144E−13 | 1.4234E−13 | 8.6425E−15 |
| 7 | −8.1358E−18 | −2.7727E−17 | 1.4903E−17 | −1.0331E−18 | −2.3513E−17 |
| 8 | −3.1961E−19 | −5.9749E−19 | −2.0426E−17 | −1.9370E−17 | −4.5428E−19 |
| 9 | 1.3403E−21 | 1.0915E−21 | −1.6778E−21 | −5.4242E−22 | 1.3656E−21 |
| 10 | 5.2911E−23 | 2.0677E−23 | 1.1752E−21 | 1.1445E−21 | 5.4759E−24 |

TABLE 9

| | EXAMPLE 1b | EXAMPLE 2b | EXAMPLE 3b | EXAMPLE 4b | EXAMPLE 5b |
|---|---|---|---|---|---|
| DEFLECTOR SURFACE | 56.36 | 56.36 | 56.36 | 56.36 | 56.36 |
| L1S1 | 14.5 | 14.5 | 14.5 | 14.5 | 14.5 |
| L1S2 | 47.28 | 87.16 | 55.51 | 61.20 | 96.33 |
| L2S1 | 4 | 4 | 4 | 4 | 4 |
| L2S2 | 282.859 | 242.980 | 274.628 | 268.940 | 233.811 |
| EFFECTIVE LENGTH | 136.2 | 170.0 | 143.6 | 148.8 | 177.8 |

FIG. 2 to FIG. 10 are graphs of sub image plane shift (deviation in the optical axis x direction of the focal point in the sub scanning z direction according to the location in the main scanning y direction) when the scanning optical apparatus experiences a temperature change of 15° C. The image height in the horizontal direction corresponds to the coordinate in the main scanning y direction.

Figure 2:
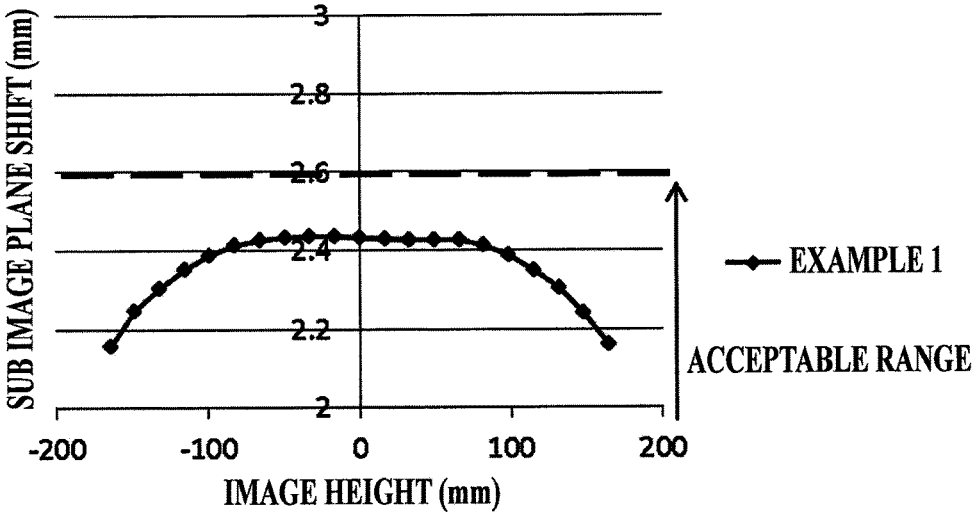
FIG. 2 is a graph of sub image plane shift in Example 1 when a scanning optical apparatus experiences a temperature change of 15° C.
Figure 3:
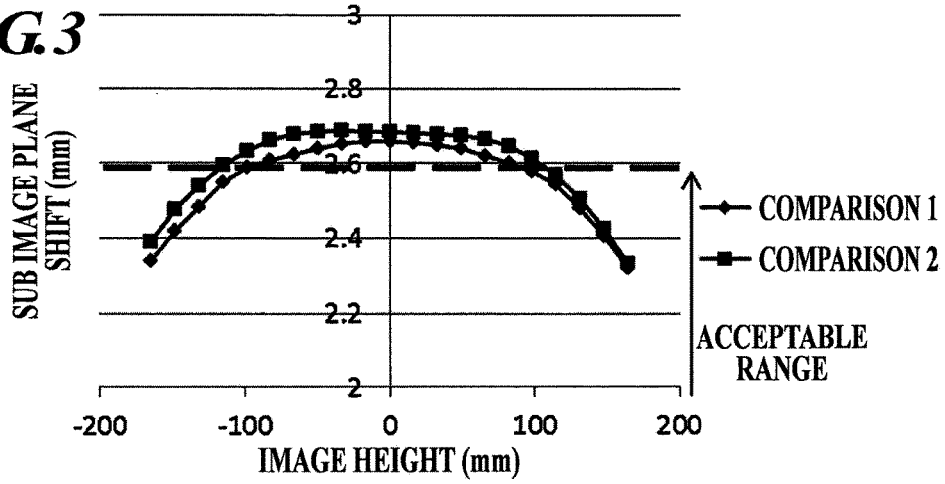
FIG. 3 is a graph of sub image plane shift in Comparison 1 and Comparison 2 when a scanning optical apparatus experiences a temperature change of 15° C.

As illustrated in FIG. 2, the sub image plane shift in Example 1 falls within the proper range of equal to or less than 2.6 mm in any image height. As illustrated in FIG. 3, the sub image plane shift in Comparison 1 and Comparison 2 exceeds the proper range when $\beta<-1.3$ and $\varphi1/\varphi2<-1.2$. Example 2 to Example 7 in FIG. 4 and FIG. 5 demonstrate that the sub image plane shift falls within the proper range when $\beta\geq-1.3$ and $\varphi1/\varphi2\geq-1.2$. The effective length in the main scanning direction of the second lens 3 is equal to or less than 180 mm (see Table 5).

The above results show that the sub image plane shift falls within the proper range so that an increase of the spot size and the wobbling can be prevented when the following conditions are met.

$$-1.2\leq\varphi1/\varphi2\leq-0.9 \quad \text{Condition 1}$$

$$-1.3\leq\beta\leq-0.8 \quad \text{Condition 2}$$

A comparison of Example 1 to Example 7 with Comparison 3 and Comparison 4 shows that the effective length in the main scanning direction of the second lens 3 falls within the proper range when the conditions of $\beta\leq-0.8$ and $\varphi1/\varphi2\leq-0.9$ are met, but the effective length in the main scanning direction of the second lens 3 exceeds 180 mm when $\beta>-0.9$ and $\varphi1/\varphi2>-0.8$ (see Table. 5).

As described above, when the above-described Condition 1 and Condition 2 are met, it is possible to bring the sub image plane shift within the proper range to prevent an increase of the spot size and the wobbling while reducing the effective length in the main scanning direction of the second lens 3 to achieve a reduction in size.

Example 1a to Example 6a and Comparison 1a to Comparison 5a are samples in which the conjugation length is extended to 405 mm. These samples (see Table 7 for the effective length in the main scanning direction of the second lens and FIG. 6 to FIG. 9 for the graphs) show that when the above-described Condition 1 and Condition 2 are met, it is similarly possible to bring the sub image plane shift within the proper range to prevent an increase of the spot size and the wobbling while reducing the effective length in the main scanning direction of the second lens 3 to 180 mm or less to achieve a reduction in size.

As seen in Comparison 3a, the sub image plane shift exceeds the proper range when L>405 mm.

That is, when the condition of L<405 mm is met, the sub image plane shift falls within the proper range, and it is thus possible to prevent an increase of the spot size and the wobbling.

Example 1b to Example 5b are samples in which the conjugation length is 350 mm. These samples (see Table 9 for the effective length in the main scanning direction of the second lens and FIG. 10 for the graph) show that when the above-described Condition 1 and Condition 2 are met, the sub image plane shift and the effective length of the second lens 3 similarly fall within the respective proper ranges.

As described above, when Condition 3 of 350 mm≤L≤405 mm is met in addition to the above-described Condition 1 and Condition 2, the sub image plane shift falls within the proper range, and it is thus possible to prevent an increase of the spot size and the wobbling.

Figure 4:
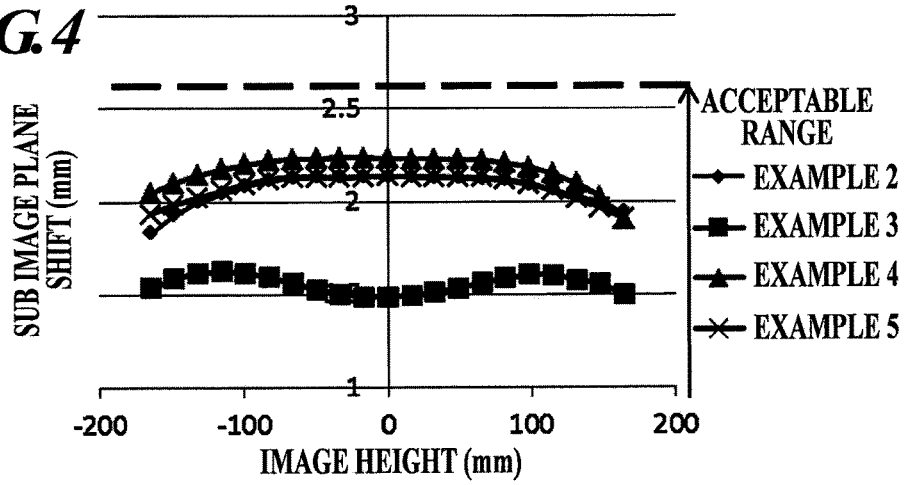
FIG. 4 is a graph of sub image plane shift in Example 2, Example 3, Example 4 and Example 5 when a scanning optical apparatus experience a temperature change of 15° C.
Figure 5:
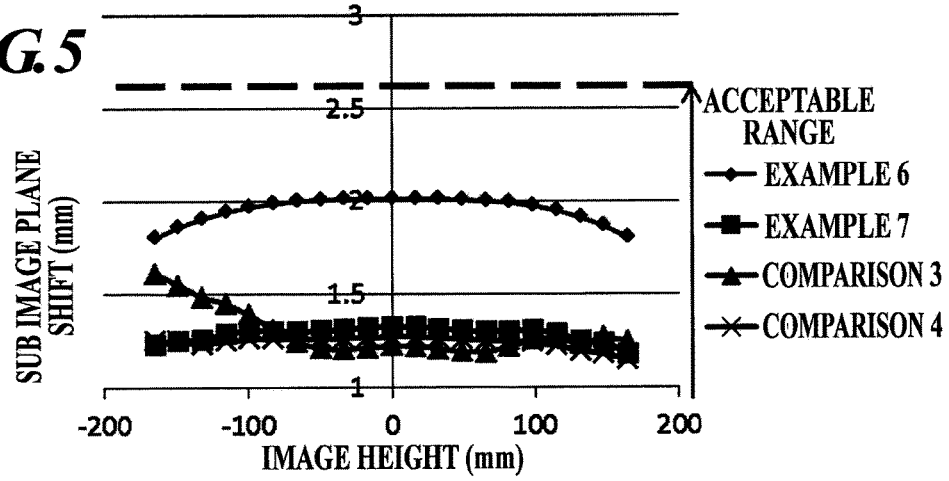
FIG. 5 is a graph of sub image plane shift in Example 6, Example 7, Comparison 3 and Comparison 4 when a scanning optical apparatus experiences a temperature change of 15° C.
Figure 6:
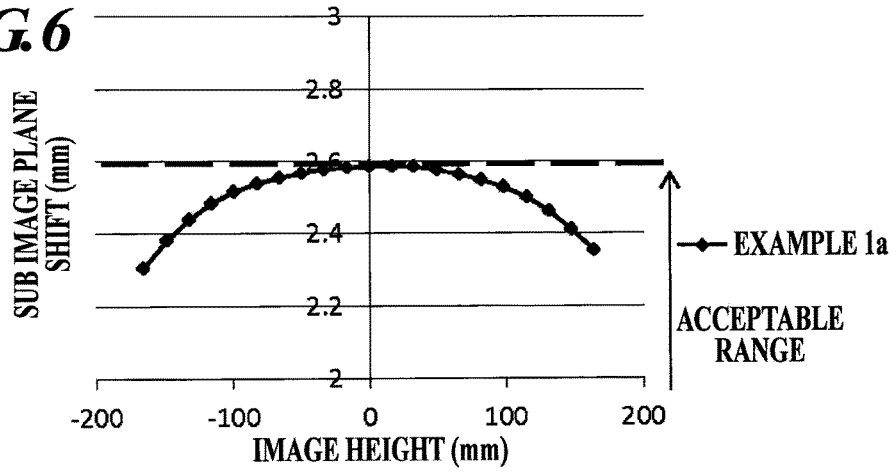
FIG. 6 is a graph of sub image plane shift in Example 1a when a scanning optical apparatus experiences a temperature change of 15° C.
Figure 7:
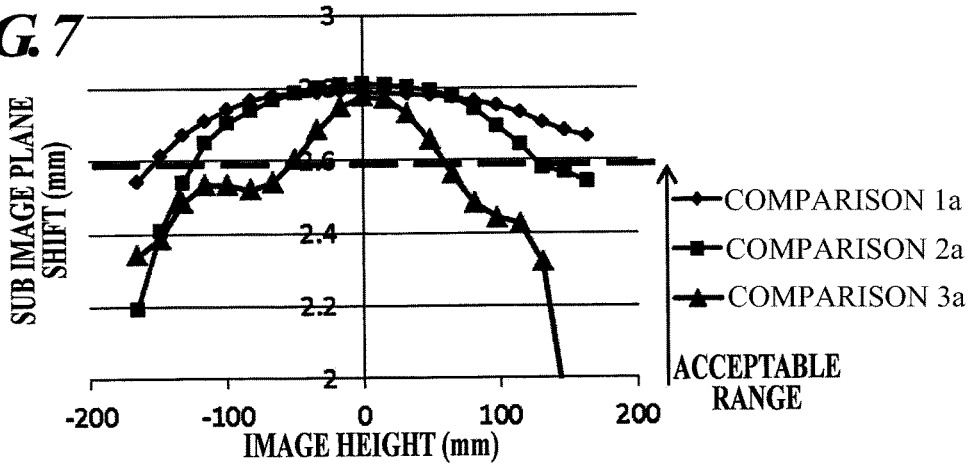
FIG. 7 is a graph of sub image plane shift in Comparison 1a, Comparison 2a and Comparison 3a when a scanning optical apparatus experiences a temperature change of 15° C.
Figure 8:
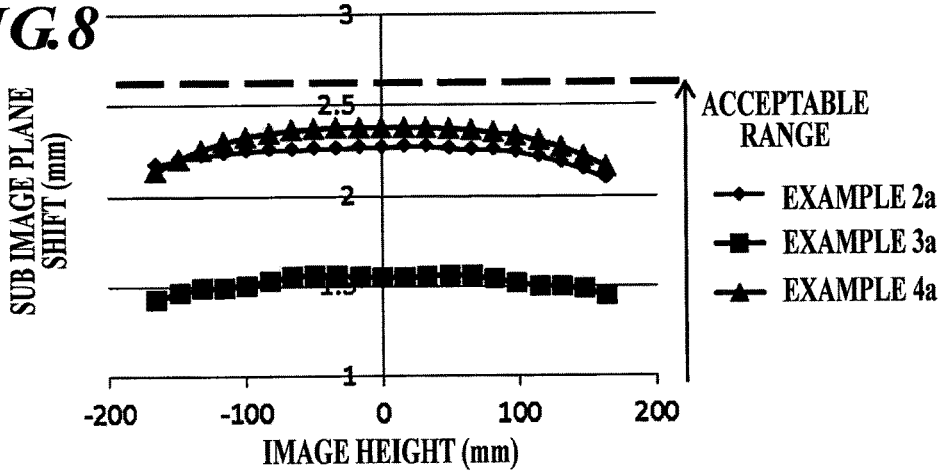
FIG. 8 is a graph of sub image plane shift in Example 2a, Example 3a and Example 4a when a scanning optical apparatus experiences a temperature change of 15° C.
Figure 9:
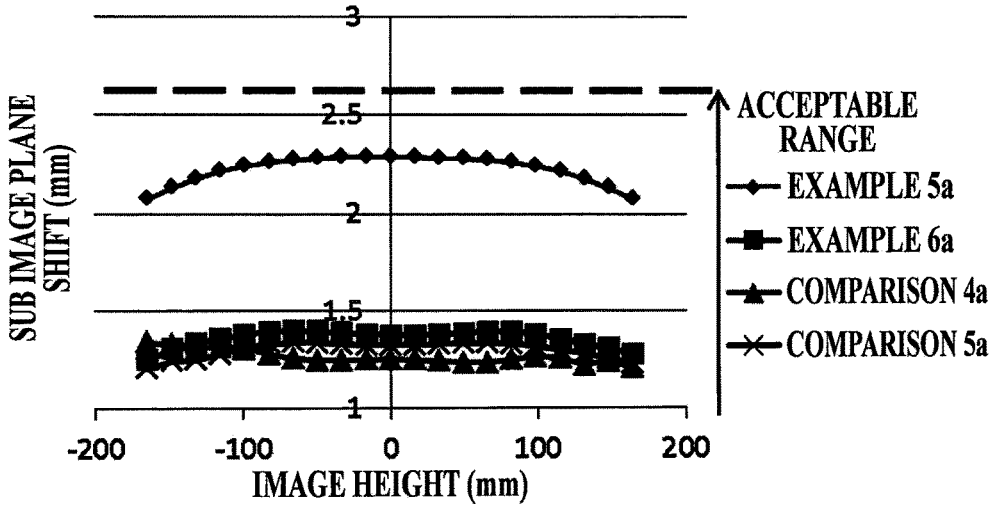
FIG. 9 is a graph of sub image plane shift in Example 5a, Example 6a, Comparison 4a and Comparison 5a when a scanning optical apparatus experiences a temperature change of 15° C.
Figure 10:
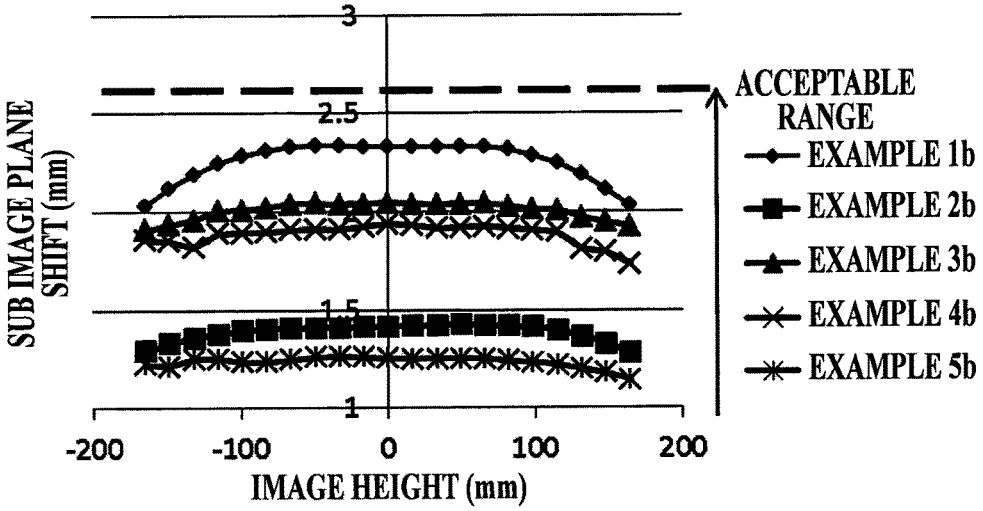
FIG. 10 is a graph of sub image plane shift in Example 1b, Example 2b, Example 3b, Example 4b and Example 5b when a scanning optical apparatus experiences a temperature change of 15° C.

The example in FIG. 4 of JP 2012-163977A has a magnification of −1.46. When the optical system is proportionally enlarged so that the maximum image height becomes the same as that of the present examples, i.e. 164.5 mm, the conjugation length and the image plane shift due to a temperature change of 15° C. become 275 mm and 3.6 mm respectively. Thus, the image plane shift is too large.

It is effective that the scanning optical apparatus of the embodiment, such as the above-described Example 1 to Example 7, Example 1a to Example 6a and Example 1b to Example 5b, further has the following configurations.

Figure 11:
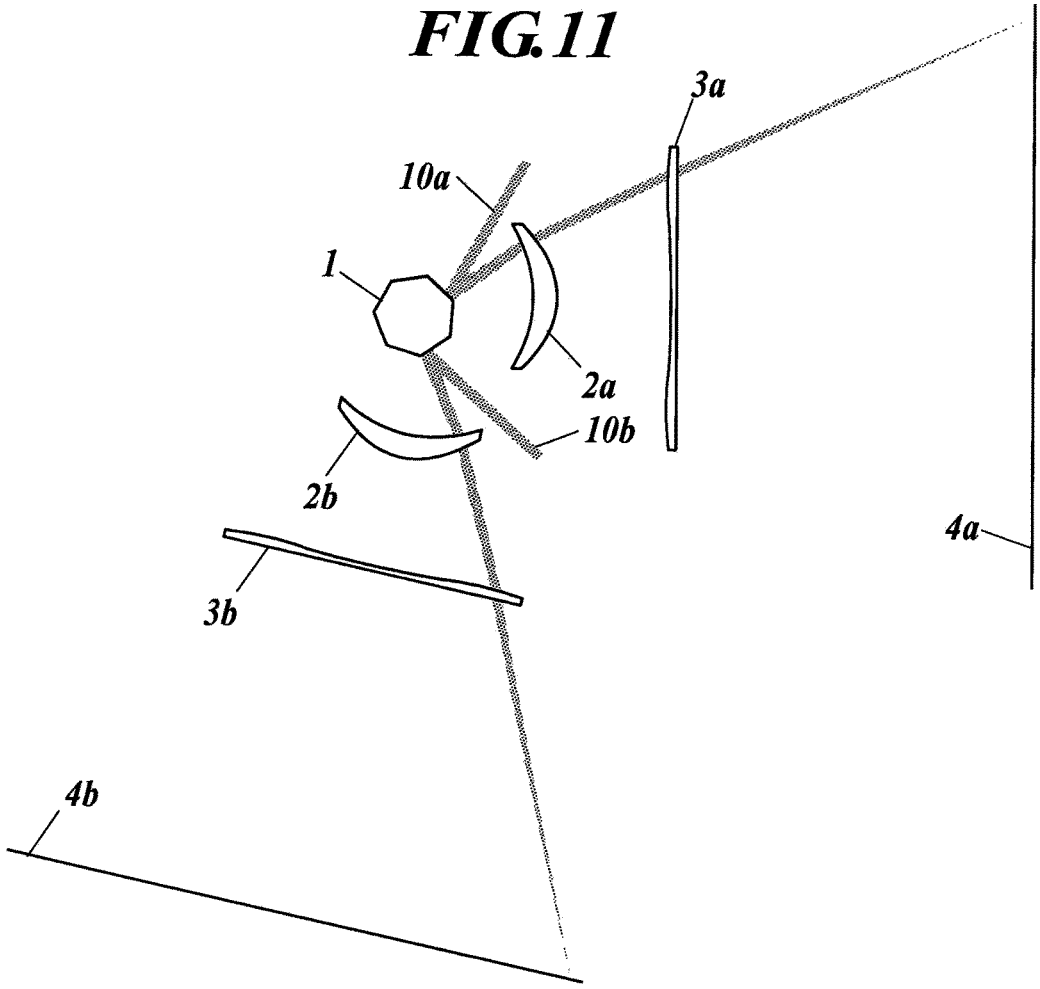
FIG. 11 illustrates the configuration of a scanning optical system according to another embodiment of the present invention.

As illustrated in FIG. 11, beams 10*a*, 10*b* emitted from respective light sources may be reflected on different faces of the same deflector 1 and focused on different scanning surfaces 4*a*, 4*b* by means of respective first lenses 2*a*, 2*b* and respective second lenses 3*a*, 3*b*. This simultaneous multi-face deflection can further reduce the size of a print head of the scanning optical apparatus and reduce the cost by means of commonality of components.

Figure 12:
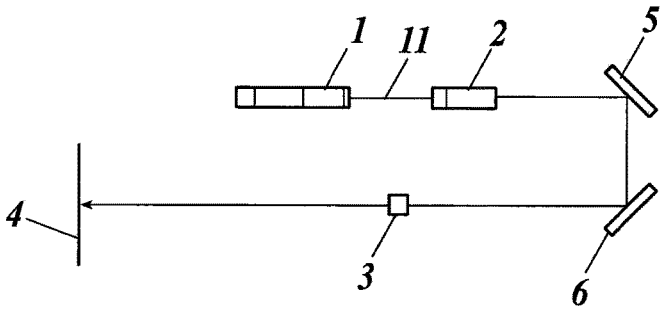
FIG. 12 illustrates the configuration of a scanning optical system according to still another embodiment of the present invention.

As illustrated in FIG. 12, a beam 11 deflected by the deflector 1 may be reflected on one or more turn-back mirrors 5, 6 and thereafter focused on the scanning surface 4. Such turn-back mirrors provide compatibility to various arrangements of the scanning optical apparatuses according to need. Suitably applying such turn-back mirrors to the simultaneous multi-face deflection in FIG. 11 enables further reduction in size of the print head and further cost reduction by means of commonality of components as well as retaining compatibility to various arrangements.

In the embodiment, the two lenses 2, 3 of the fθ lens are configured such that the first lens 2 has negative power in the sub scanning z direction while the second lens 3 has positive power in the sub scanning z direction. This configuration enables disposing the second lens 3 near the deflector and thereby reducing the size of the second lens 3. Further, the powers $\varphi 1$ and $\varphi 2$ in the sub scanning z direction of the first lens 2 and the second lens 3 and the magnification $\beta$ in the sub scanning z direction of the imaging optical system satisfy $-1.2 \leq \varphi 1/\varphi 2 \leq -0.9$ (Condition 1) and $-1.3 \leq \beta \leq -0.8$ (Condition 2). This configuration enables reducing the sub scanning image plane shift due to temperature change and preventing an increase of the spot size and the wobbling.

In the embodiment, the long conjugation length L ensures compatibility to various arrangements of the apparatus according to need. In an apparatus that includes two or more scanning optical systems for scanning respectively different photoreceptor drums for example, folding the beam by means of mirrors as illustrated in FIG. 12 after deflecting it by means of the deflector 1 allows various arrangements of the photoreceptor drums and a print head in which the scanning optical system is housed. Further, the size of a print head dominantly depends on the length of the second lens 3 in the main scanning y direction. To reduce the size of a print head, it is desirable that the effective length of the second lens 3 in the main scanning direction is equal to or less than 180 mm. This is achievable in the embodiment.

When the conjugation length L satisfies $350\ \text{mm} \leq L \leq 405\ \text{mm}$, it is possible to satisfy all conditions of the extended conjugation length L, the effective length in the main scanning direction being 180 mm or less, and the above-described Condition 1 and Condition 2.

Although embodiments of the present invention have been described and illustrated in detail, the disclosed embodiments are made for purposes of illustration and example only and not limitation. The scope of the present invention should be interpreted by terms of the appended claims.

The entire disclosure of Japanese patent application No. 2016-237404, filed on Dec. 7, 2016, is incorporated herein by reference in its entirety.

What is claimed is:

1. A scanning optical apparatus, comprising:

a light source;

a deflector which deflects a beam emitted from the light source to scan a scanning surface with the beam in a main scanning direction; and an imaging optical system which focuses the beam deflected by the deflector on the scanning surface, wherein the imaging optical system comprises a first lens having negative power $\varphi 1$ in a sub scanning direction and a second lens having positive power $\varphi 2$ in the sub scanning direction, in which the sub scanning direction is parallel to the scanning surface and perpendicular to the main scanning direction, and wherein the power $\varphi 1$ in the sub scanning direction of the first lens, the power $\varphi 2$ in the sub scanning direction of the second lens and a magnification $\beta$ in the sub scanning direction of the imaging optical system satisfy the following conditions:

$$-1.2 \leq \varphi 1/\varphi 2 \leq -0.9$$

$$-1.3 \leq \beta \leq -0.8.$$

2. The scanning optical apparatus according to claim 1, wherein a distance L from a point where the deflector reflects the beam to the scanning surface is $350\ \text{mm} \leq L \leq 405\ \text{mm}$.

3. The scanning optical apparatus according to claim 1, wherein the light source comprises two or more light sources, and beams emitted from the respective light sources are reflected on different faces of the same deflector and then focused on different scanning surfaces.

4. The scanning optical apparatus according to claim 1, wherein the beam deflected by the deflector is reflected on one or more turn-back mirrors and then focused on the scanning surface.

5. An image forming apparatus, comprising:

a scanning optical apparatus which forms an electrostatic latent image on a scanning surface; and a developer which develops the electrostatic latent image, in which the image forming apparatus forms an image on a recording medium by transferring the image developed by the developer to the recording medium, wherein the scanning optical apparatus comprises:

a light source;

a deflector which deflects a beam emitted from the light source to scan the scanning surface with the beam in a main scanning direction; and an imaging optical system which focuses the beam deflected by the deflector on the scanning surface, wherein the imaging optical system comprises a first lens having negative power $\varphi 1$ in a sub scanning direction and a second lens having positive power $\varphi 2$ in the sub scanning direction, in which the sub scanning direction is parallel to the scanning surface and perpendicular to the main scanning direction, and wherein the power $\varphi 1$ in the sub scanning direction of the first lens, the power $\varphi 2$ in the sub scanning direction of the second lens and a magnification $\beta$ in the sub scanning direction of the imaging optical system satisfy the following conditions:

$$-1.2 \leq \varphi 1/\varphi 2 \leq -0.9$$

$$-1.3 \leq \beta \leq -0.8.$$

6. The image forming apparatus according to claim 5, wherein a distance L from a point where the deflector reflects the beam to the scanning surface is $350\ \text{mm} \leq L \leq 405\ \text{mm}$.

7. The image forming apparatus according to claim 5, wherein the light source comprises two or more light sources, and beams emitted from the respective light sources are reflected on different faces of the same deflector and then focused on different scanning surfaces.

8. The image forming apparatus according to claim 5, wherein the beam deflected by the deflector is reflected on one or more turn-back mirrors and then focused on the scanning surface.

* * * * *